US005157211A

United States Patent [19]

Mossberg

[11] Patent Number: 5,157,211

[45] Date of Patent: Oct. 20, 1992

[54] CHOKE TUBE ASSEMBLY

[75] Inventor: Alan I. Mossberg, St. Petersburg, Fla.

[73] Assignee: O. F. Mossberg & Sons Inc., North Haven, Conn.

[21] Appl. No.: 830,077

[22] Filed: Jan. 31, 1992

[51] Int. Cl.[5] ..... F41A 21/40

[52] U.S. Cl. ..... 42/79

[58] Field of Search ..... 42/79

[56] References Cited

U.S. PATENT DOCUMENTS 2,779,119 1/1957 Fawcell ..... 42/79
2,922,242 1/1960 Pachmayr et al. ..... 42/79
2,968,111 1/1961 Steane ..... 42/79
3,769,731 11/1973 Pachmayr et al. ..... 42/79
4,058,925 11/1977 Linde et al. ..... 42/79

*Primary Examiner*—Michael J. Carone
*Attorney, Agent, or Firm*—McCormick, Paulding & Huber

[57] ABSTRACT

A choke tube assembly having a rear part and a front part selected from a plurality of front parts is releasably retained within a stepped cylindrical bore in the muzzle end of a shotgun barrel. The front and rear parts cooperate to define a forwardly converging forcing cone contiguous to a cylindrical choke bore which opens through the forward end of the front part. Each of the front parts define a choke bore of a different diameter. The shot pattern characteristics of the gun barrel may be altered by substituting one front part for another having a different choke characteristic.

16 Claims, 1 Drawing Sheet

CHOKE TUBE ASSEMBLY

BACKGROUND OF THE INVENTION

This invention relates to firearms and deals more particularly with an improved choke tube assembly for a shotgun.

Heretofore, shotguns have been available with interchangeable choke tubes which enable a shooter to select the most appropriate barrel/choke tube combination which will provide an appropriate shot pattern suited to the shooters particular requirements. However, the increasing use of ecologically friendly steel shot in shotgun ammunition has imposed somewhat more stringent requirements for the manufacture of choke tubes. The use of more costly materials which are somewhat more difficult to machine has resulted in a substantial cost increase in the production of choke tubes.

Accordingly, it is the general aim of the present invention to provide an improved choke tube assembly which retains all of the advantages of existing choke tubes and may be manufactured at reduced cost.

SUMMARY OF THE INVENTION

In accordance with the invention a gun choke comprises a choke assembly which has a tubular rear part and a separate tubular front part selected from a plurality of front parts. The rear part has a substantially uniform outside diameter throughout a substantial portion of its axial length and a coaxial forwardly converging conically tapered rear bore portion which defines a portion of a forcing cone. Each of said front parts has a substantially uniform outside diameter throughout a substantial portion of its axial length, an outside diameter greater than the outside diameter of the rear part and a forwardly diverging conically tapered front bore portion which further defines the forcing cone. Each of said front parts also has a generally cylindrical choke bore which is contiguous with the forward end of the conically tapered front bore portion and opens through the forward end of said front part. The choke bore of each front parts is of a different diameter. A means is provided for releasably retaining the choke assembly in assembled relation to and within a choke receiving bore formed within and opening outwardly through the muzzle end of an associated barrel.

DETAILED DESCRIPTION OF PREFERRED EMBODIMENT

Figure 1:
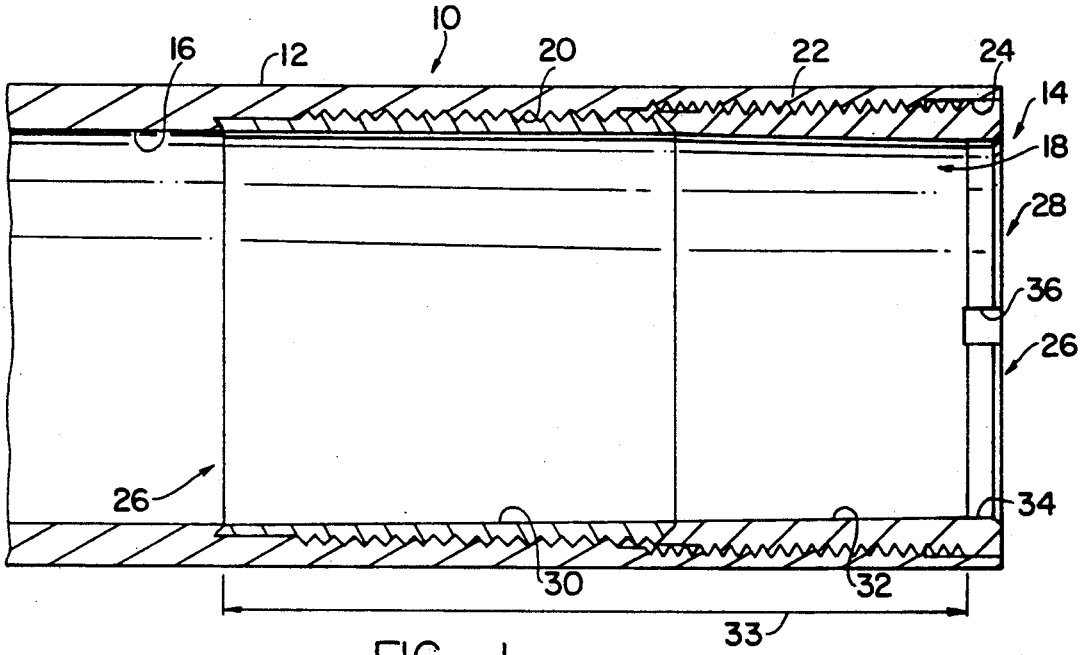
FIG. 1 is an axial sectional view through a barrel assembly embodying the present invention.
Figure 2:
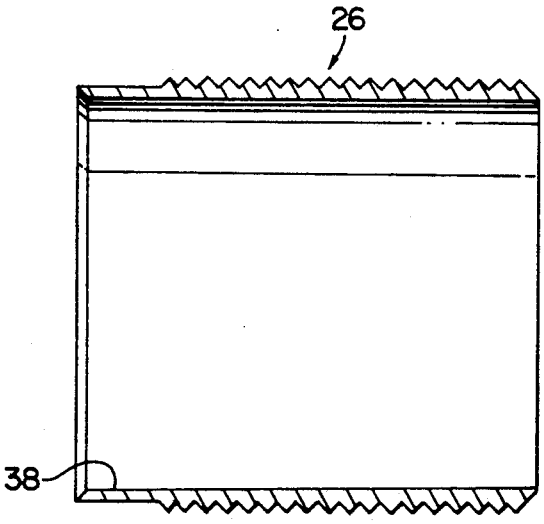
FIG. 2 is an axial sectional view through the rear part of the choke tube assembly shown in FIG. 1.

In the drawing and in the description that follows the invention is illustrated and described with reference to an improved shotgun barrel assembly designated generally by the reference numeral 10. The illustrated barrel assembly 10 includes a shotgun barrel 12 and a choke tube assembly, indicated generally at 14, embodying the present invention and releasably secured within the forward or muzzle end of the barrel 12.

The illustrated shotgun barrel 12 has an axially elongate gun bore 16 extending through it and terminating at a choke receiving bore, indicated generally at 18, which opens through the forward or muzzle end of the barrel. The choke receiving bore 18 is further characterized as a generally cylindrical stepped bore and has a first bore portion 20 communicating with the forward end of the gun bore 16 and a second bore portion 22 forward of and communicating with the first bore portion. At least the second bore portion defines an internal thread, but preferably, and as shown, both the first and second portions of the choke receiving bore are internally threaded, the pitch diameter of the thread on the first bore portion 20 being somewhat different than the pitch diameter of the thread on the second bore portion 22. The illustrated gun barrel 12 also has a smooth generally cylindrical third bore portion 24 of relatively short axial extent which opens through its forward or muzzle end.

Considering now the choke assembly in further detail, the illustrated choke assembly 14 is formed by two separate tubular parts and includes an inner or rear part 26 indicated generally at 26 and an outer or front part selected from a plurality of front parts and designated generally by the numeral 28 in FIG. 1

The rear part 26 has a generally uniform outside diameter along a substantial portion of its axial length and a coaxial conically tapered and forwardly converging rear bore portion 30 which defines part of a forcing cone, hereinafter further discussed.

Each front part has a generally uniform outside diameter along a substantial portion of its length and is somewhat greater in diameter than the rear part 26. Each front part further includes a coaxial conically tapered and forwardly converging front bore portion 32 which further defines the forcing cone indicated by the numeral 33 in FIG. 1. The front bore portion 32 may have the same taper per unit length as the rear bore portion 30. However, in the illustrated barrel assembly 10 the taper per unit length of the front bore portion 32 is somewhat greater than that of the rear bore portion 30. Each front part also has a generally cylindrical choke bore 34 which communicates with the forward end of the front bore portion 32 and opens through the muzzle end of the front part 28. The major diameter of the front bore portion 32 is somewhat greater than the minor diameter of the rear bore portion 30. The major diameter of the rear bore portion 30 is, in turn, somewhat larger than the diameter of the gun bore 16. Diametrically opposed key slots 36, 36 (one shown) are formed in the wall of the front part 28 and open through the forward end of the front part for receiving a key used to assembled the front part with and remove it from the barrel 12.

At least the front part 28 is externally threaded along a portion of its axial length to engage threads defined by the second front bore portion 22 to releasably retain the choke tube assembly 14 within the choke receiving bore 18. Preferably, and as shown, both the rear part 26 and the front part 28 are externally threaded to engage threads within the respectively associated first and second portions of the choke receiving bore 18. The pitch diameter of the threads on the front part differs from the pitch diameter of the threads on the rear part so that the choke parts cannot be improperly assembled with an associated barrel.

Figure 3:
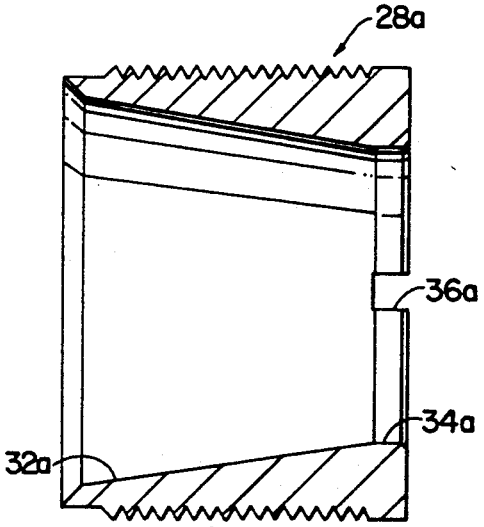
FIG. 3 is an axial sectional view through another front part embodying the invention.

The front part 28, shown in FIG. 1, is typical of the front parts which may be used in combination with the rear part 26 to form a choke tube assembly. However, another front part which may be used with the rear part 26 is shown in FIG. 3 and indicated generally at 28*a*. Portions of the front part 28*a* which correspond to portions of the front part 28, previously described, bear the same reference numeral and a letter "a" suffix.

The illustrated front part 28*a* is identical in most respects to the front part 28, but has a somewhat smaller choke bore 34*a* than that of the previously described front part 28. The taper per unit length of the front bore portion 32*a* is also somewhat greater than that of the previously described embodiment.

It will now be apparent that numerous barrel/choke tube combinations may be attained to provide a full range of shot patterns by simply substituting one front part for another.

I claim:

1. A gun choke comprising a choke assembly including a tubular rear part having a substantially uniform outside diameter throughout a substantial portion of its axial length and a coaxial forwardly converging conically tapered rear bore portion defining a portion of a forcing cone, and a tubular front part selected from a plurality of front parts, each of said front parts having a substantially uniform outside diameter throughout a substantial portion of its axial length and an outside diameter greater than the outside diameter of said rear part, each of said front parts having a forwardly diverging conically tapered front bore portion further defining said forcing cone and a generally cylindrical choke bore contiguous with the forward end of said conically tapered front bore portion and opening through the forward end thereof, each of said front parts having a choke bore of a different diameter, and means for releasably retaining said choke assembly in assembled relation to and within a choke receiving bore formed within and opening outwardly through the muzzle end of an associated gun barrel.

2. A gun choke as set forth in claim 1 wherein said retaining means comprises an external thread on said front part.

3. A gun choke as set forth in claim 2 wherein said retaining means includes an external thread on said rear part.

4. A gun choke as set forth in claim 3 wherein the pitch diameter of said thread on said rear part is different from the pitch diameter of said thread on said front part.

5. A gun choke as set forth in claim 1 wherein the minor diameter of the conically tapered rear part is greater than the major diameter of the conically diverging front part.

6. A gun choke as set forth in claim 1 wherein said front part has a generally cylindrical outer peripheral surface at its forward end.

7. A gun choke as set forth in claim 1 wherein the conical taper of said front bore portion differs from the conical taper of said rear bore portion.

8. A gun choke as set forth in claim 1 wherein said front bore portion has a greater conical taper than said rear bore portion.

9. A choke tube assembly comprising a tubular rear part and a tubular front part selected from a plurality of front parts, said rear part having a substantially uniform outside diameter throughout a substantial portion of its axial length and a coaxially conically tapered and forward converging rear bore portion defining a portion of a forcing cone, said rear part having an external thread thereon, each of said front parts having a substantially uniform outside diameter throughout a substantial portion of its axial length and an outside diameter of greater than the outside diameter of said rear part, each of said front parts having a coaxial conically tapered and forwardly converging front bore portion defining the remainder of said forcing cone and having a conical taper greater than the conical taper of said rear bore portion, each of said front parts having a substantially cylindrical choke bore forward of said rear bore portion and opening through the forward end thereof, each of said front parts having an external thread thereon, the diameter of said choke bore of each of said front parts differing from the diameter of said choke bore of the other of said parts.

10. In a gun barrel assembly having a barrel defining an axially elongate gun bore and a coaxial choke receiving bore communicating with the forward end of the gun bore and opening through the muzzle end of the barrel, a choke tube disposed within the choke receiving bore and means for releasably retaining the choke tube in assembly with the barrel within the choke receiving bore, the improvement comprising said choke receiving bore having a first bore portion communicating with the forward end of said gun bore and having a diameter greater than the diameter of said gun bore and a second bore portion communicating with the forward end of said first bore portion and opening through said muzzle end, said second bore portion having a diameter greater than the diameter of said first bore portion, said tubular choke including a rear part received within said first bore portion and having a substantially uniformed diameter throughout a substantial portion of its axial length and a coaxially forwardly converging conically tapered rear bore portion communicating with said gun bore and defining a portion of a forcing cone, and a tubular front part selected from a plurality of front parts and disposed within said second bore portion, each of said front parts having an outside diameter greater than the outside diameter of said rear part and a forwardly diverging conically tapered front bore portion further defining said forcing cone, each of said front parts having a generally cylindrical choke bore contiguous with the forward end of said conically tapered front bore portion and opening through the forward end of said front part, each of said front parts having a choke bore of a different diameter.

11. In a gun barrel assembly as set forth in claim 10 the further improvement wherein said retaining means comprises cooperating threads on said front part and said second bore portion.

12. In a gun barrel assembly as set forth in claim 11 the further improvement wherein said retaining means further includes co-engaging threads on said rear part and said second bore portion.

13. In a gun barrel assembly as set forth in claim 12 the further improvement wherein the conical taper of said front bore portion differs from the conical taper of said rear bore portion.

14. In a gun barrel assembly as set forth in claim 13 the further improvement wherein said front bore portion has a greater conical taper than said rear bore portion.

15. In a gun barrel assembly as set forth in claim 10 the further improvement wherein the major diameter of said front bore portion is greater than the minor diameter of said rear bore portion.

16. In a gun barrel assembly as set forth in claim 10 the further improvement wherein said choke receiving bore has a generally cylindrical diametrically enlarged third bore portion communicating with the forward end of said second bore portion and opening through the forward end of said barrel and said front part has a generally cylindrical peripheral surface at its forward end received within and generally complementing said third bore portion.

* * * * *